US006226842B1

(12) United States Patent
Wong

(10) Patent No.: US 6,226,842 B1
(45) Date of Patent: May 8, 2001

(54) WATERPROOF, WASHABLE PLASTIC MAGNETIC BUTTON AND A METHOD FOR MANUFACTURING IT

(75) Inventor: Sheung Chung Wong, Kowloon (HK)

(73) Assignee: Hing Ngai Company Limited, Kowloon (HK)

( * ) Notice: Subject to any disclaimer, the term of this patent is extended or adjusted under 35 U.S.C. 154(b) by 0 days.

(21) Appl. No.: 09/361,832

(22) Filed: Jul. 27, 1999

(30) Foreign Application Priority Data

Jan. 12, 1999 (CN) ..... 99100120

(51) Int. Cl.[7] ..... A44B 17/00; A44B 21/00
(52) U.S. Cl. ..... 24/303; 24/66.1
(58) Field of Search ..... 24/303, 66.1

(56) References Cited

U.S. PATENT DOCUMENTS 2,319,292 * 5/1943 Boggs ..... 24/303
2,363,914 * 11/1944 Wakefield ..... 24/303
3,086,268 * 4/1963 Chaffin, Jr. ..... 24/303
3,378,893 * 4/1968 Labek ..... 24/303
4,399,595 * 8/1983 Yoon et al. ..... 24/303
4,991,270 * 2/1991 Aoki ..... 24/303
5,450,658 * 9/1995 Hicks ..... 24/303
5,732,451 * 3/1998 Mars ..... 24/303

* cited by examiner

*Primary Examiner*—Victor N. Sakran
(74) *Attorney, Agent, or Firm*—Jones, Day, Reavis & Pogue

(57) ABSTRACT

A plastic magnetic button that is waterproof and washable incluses a button body, a magnet and a steel plate disposed inside the cavity of said button body. The method of manufacturing the magnetic button comprises step A: manufacturing a button body with non-magnetic material, step B: putting the magnet and steel plate into the cavity of said button body, and step C: injecting a resinoid into the cavity and sealing the magnet and steel plate completely inside the cavity and combining integrally after hardening. The magnetic button can be used on clothes, can automatically align and match each other and is best suited for the case where buttons are not easy to be unbuttoned with the hands, such as, when both hands are in gloves.

11 Claims, 4 Drawing Sheets

WATERPROOF, WASHABLE PLASTIC MAGNETIC BUTTON AND A METHOD FOR MANUFACTURING IT

CROSS-REFERENCE TO RELATED APPLICATION

This application claims foreign priority benefit under Title 35, U.S.C. §119 of Chinese Patent Application No. 99100120.6, filed Jan. 12, 1999.

BACKGROUND OF THE INVENTION

1. Field of the Invention

The present invention relates to a kind of fastener and a method of its manufacture, more particularly, to a waterproof and washable magnetic button and method of manufacturing it.

2. Description of the Related Art

The conventional magnetic button used on articles, such as trunks, cases or bags is usually composed of a top plate and a magnetic button main body. The top plate of the magnetic button has fitting legs, and the magnetic button main body comprises a case, a magnet disposed inside the case and a button cover with fitting legs. The magnetic button is fixed on articles, such as gloves, bags, etc, through the fitting legs disposed on the top plate and back plate for opening and closing the cover of the glove and bag. However, such kind of convenient magnetic button cannot be used on those articles which require opening and closing frequently, such as overcoats, leather coats, suits, etc. The reason is that the conventional magnet does not have strong magnetism (the magnetic field intensity is about 500 Gauss). In order to intensify the magnetism, the only way is to increase the size or thickness of the magnet to 8 mm in the usual case, and thus it is not suitable for use on clothings. Secondly, there is no way to bore a needle hole on the magnetic button for fixing it on clothes as the conventional button is. Thirdly, as the magnetic button is made by pressing the steel sheet, the occurrence of rust cannot be avoided though it is processed with electroplating or anticorrosive treatment. And fourthly, conventional magnetic buttons do not undergo anticorrosive treatment, so it cannot be washed with water.

SUMMARY OF THE INVENTION

In order to overcome the above disadvantages of the magnetic button, extending the application scope of the magnetic button from articles such as gloves, bags, etc. to the category of clothes, the present invention provides a magnetic button which is waterproof and washable. The other object of the present invention is to provide a method of manufacturing a magnetic button which is waterproof and washable.

The object of the present invention can be realized as follows. The magnetic button of the present invention comprises:

a button body having a decorative top button face, said top button face is a projecting extending plane, its periphery being the rim lower than the top button face, said rim portion is provided with a through hole for affixing the magnetic button; its reverse surface is a flat back button face, a cavity is provided in between said top button face and back button face and is isolated from the outside;

a magnet disposed inside the cavity of the button body and each of the two sides is N pole and S pole; and a steel plate whose shape and size match with said magnet, its edge extends vertically to one direction so that the extended edge surrounds the magnet and places on one of the surfaces of said magnet.

The method of manufacturing the magnetic button comprises the following steps:

Step A: make a button body with non-magnetic material, which button body has a decorative top button face, said top button face has a swelled extending surface, and around it is the edge portion lower than the surface of top button plate, in said edge portion are disposed with through holes for affixing the magnetic button, the reverse side is generally a flat back button face, a cavity being disposed inbetween said top button face and back button face;

Step B: place the magnet into said cavity in a fixed magnetic pole direction, then place in the steel plate so that the steel plate joins with the magnetic due to magnetic force, and the vertically extended edge portion surrounds the magnet;

Step C: inject the resinoid into the cavity of the button body which has been disposed with the magnet and the steel plate, said magnet and steel plate being completely sealed within the button body and combined integrally after being hardened.

Thus the magnetic button made by the method of present invention is waterproof and washable as the magnet is enclosed by non-magnetic material and sealed. In addition there are no through holes disposed around the edge portion so it can be applied conveniently to clothes as ordinary buttons. Furthermore, as the magnetic button according to the present invention can automatically attract and combine each other due to its strong magnetic force, it is well suited for use in cold weather or the situation wherein the button cannot be unbuttoned due to certain reasons, such as when both hands are wearing gloves.

BRIEF DESCRIPTION OF THE DRAWINGS

The present invention will be described in more detail with reference to the attached drawings and preferred embodiments.

DETAILED DESCRIPTION OF THE PREFERRED EMBODIMENT(S)

Figure 1:
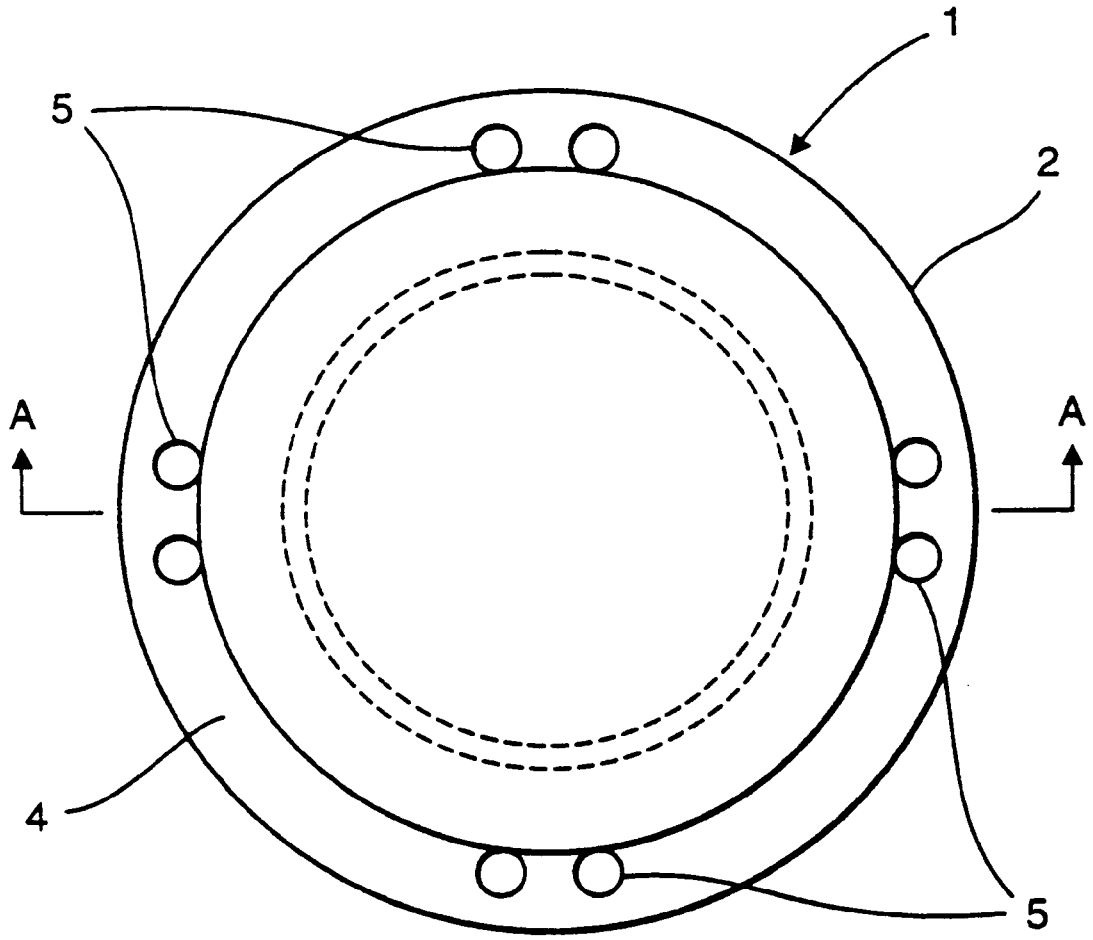
FIG. 1 is a top plan view of a magnetic button according to the present invention.
Figure 2:
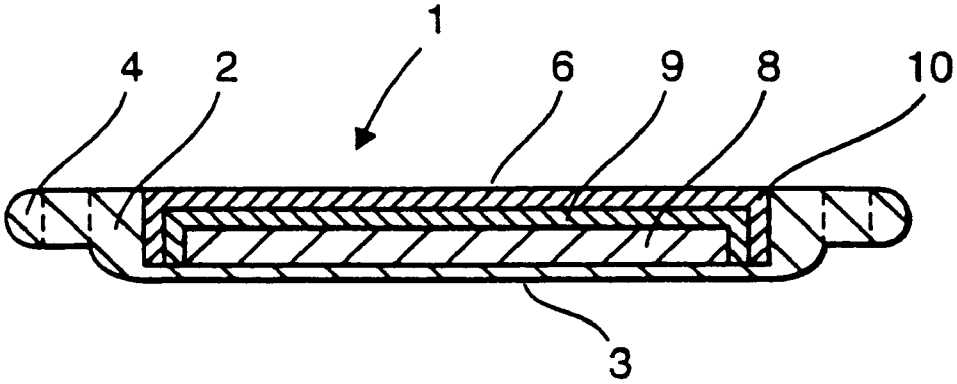
FIG. 2 is a sectional view along line A—A in FIG. 1.
Figure 3:
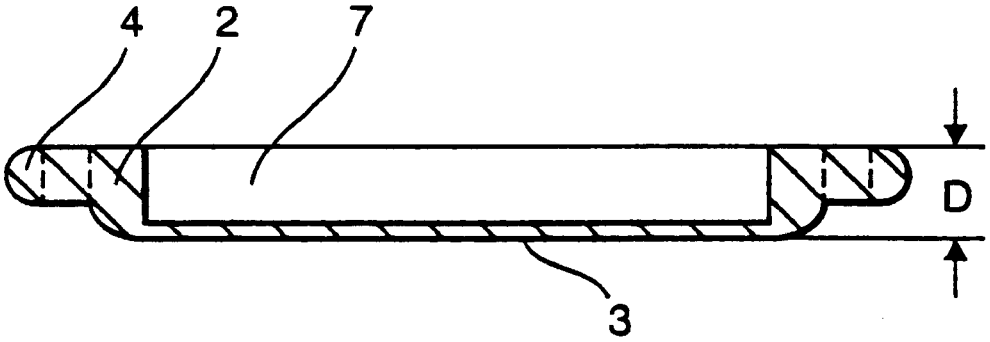
FIG. 3 is a sectional view of the button body of the magnetic button according to the present invention.

Referring to FIG. 1 and FIG. 2, the magnetic button 1 according to the present invention comprises a button body 2 having a top button face 3 which is decorative. The top button face 3 is a swelled extending surface with its surrounding lower than the edge portion 4 of the surface of top button face 3. In the edge portion 4 is disposed a through hole 5 for fixing the magnetic button. Its reverse side is a roughly flat back button face 6. Inside the top button face 3 and back button face 6 is disposed a cavity 7. Isolated from the outside, a magnet 8 is disposed inside the cavity 7 of the button body 2 and both sides are N pole and S pole. A steel plate 9, the shape and size of which match with the magnet 8, has its edge being vertically extending to one direction so that its extended edge just surrounds the magnet 8, namely the steel plate 9 is laid on one side of the magnet 8, and the height of the extending edge is roughly equal to the thickness of the magnet 8.

Generally, the button body 2 has a round shape, but it can be made into square, oval, triangle, etc. as required by the clothing. The button body is made of non-magnetic material, such as nylon, PVC, resin etc., preferably nylon, PVC ABS plastics, resin. Conventional methods are used to make the button body according to different requirements and different materials. If PVC material is adopted, then moulding is used. The thickness D or the button body 2, i.e. the vertical distance between top button face and back button face is preferably 2.5–3.5 mm. The magnet 8 is made of strong magnetic alloy, such as neodymium-iron-boron magnetic alloy, which has a maximum magnetic field density of 1500 Gauss, which is three time that of the magnet currently used in the conventional magnetic buttons (the magnetic field density is about 500 Gauss). Besides, the thickness of the magnet 8 adopted by present invention is 1.0–1.5 mm, while for the ordinary magnetic buttons, they cannot achieve the required magnetic force even it the thickness is increased to 8.0 mm in order to increase their attraction force. The most commonly adopted shapes is round, with one side as N pole, and the other side S pole.

The use of magnetic plate 9 concentrates the magnetic force onto the button face in collaboration with the magnet, that is to say, to increase the magnetic force on the surface of the button face, and at the same time, decrease the magnetic force on the back button face. The steel plate 9 is formed by pressing the steel sheet, its thickness is 0.5–0.6 mm.

Figure 4:
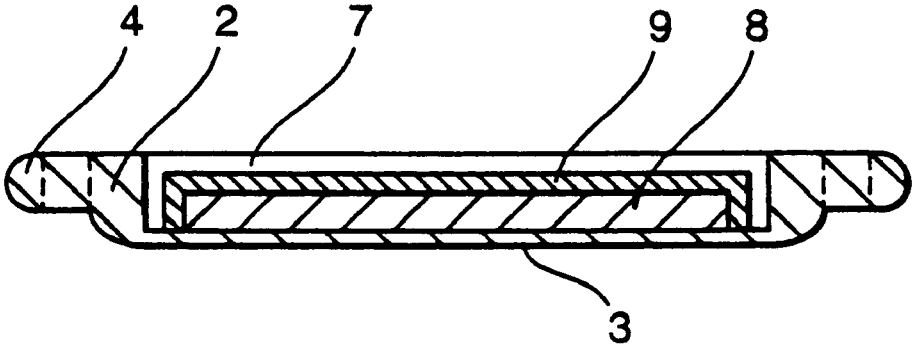
FIG. 4 is a sectional view of the button body fixed in with magnet and steel plate, but not yet sealed.

The method of manufacturing the magnetic button 1 of the present invention comprises the following steps:

Step A: make a button body 2 with non-magnetic material (refer to FIG. 2), which button body has a decorative top button face 3, said top button face 3 has a swelled extending surface, and around it is the edge portion 4 lower than the surface of top button plate, in said edge portion 4 are disposed with through holes 5 for affixing the magnetic button, the reverse side is disposed a cavity 7;

Step B: place the magnet 8 into the cavity 7 in a fixed magnetic pole direction, then set the S pole against top button face 3 and put it into the formed magnetic button with a sign "magnetic button A1", then set the N pole against back button face 3 and put it into the formed magnetic button with a sign "magnetic button B1"; then put in the steel plate 9 so that the plate 9 joins with the magnet 8 due to magnetic force of magnet 8, with its vertically extended edge portion surrounds the magnet 8 (refer to FIG. 4);

Step C: inject the resinoid 10 into the cavity 7 of button body which has been disposed with magnet 8 and steel plate 9, said magnet 8 and steel plate 9 are completely sealed within the button body 2 and combined integrally after being hardened (refer to FIG. 2).

Figure 5:
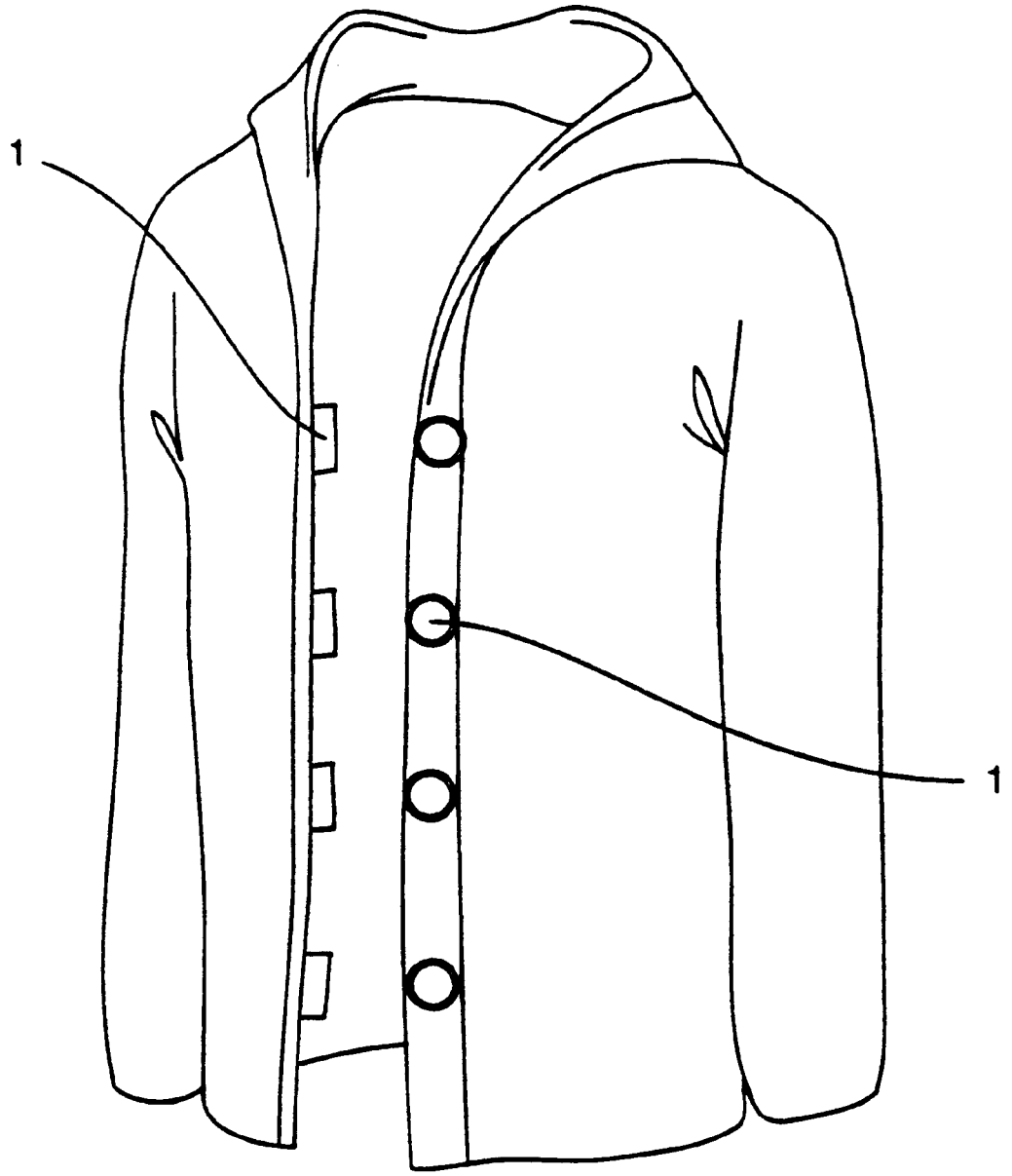
FIG. 5 is a schematic view of a suit adopting the magnetic button of the present invention.

The magnetic button A1, B1 made through the above steps can be separately sewn on the clothes for use as buttons. Referring to FIG. 5, the magnetic buttons A1 of the present invention are sewn on the positions of a row of buttons of a coat, and the magnetic buttons B1 of the present invention are sewn on the corresponding position of the coat on the reverse side. As the polarities of magnetic buttons A1 and B1 are opposite contrary to each other, they not only automatically attract and combine each other, but also automatically match the positions of the two buttons. Once putting on the clothes with the magnetic button of the present invention, you can hear the sound of automatic buttoning of the magnetic buttons. When taking off the clothes, the buttons can be separated with little force.

In another case, the magnetic buttons of the present invention can be sewn on the coat, in a row, and another row of top button covers can be sewn. The efficacy and use are as above, but the attraction of magnetic force is lower than that of the above magnetic buttons.

Figure 6:
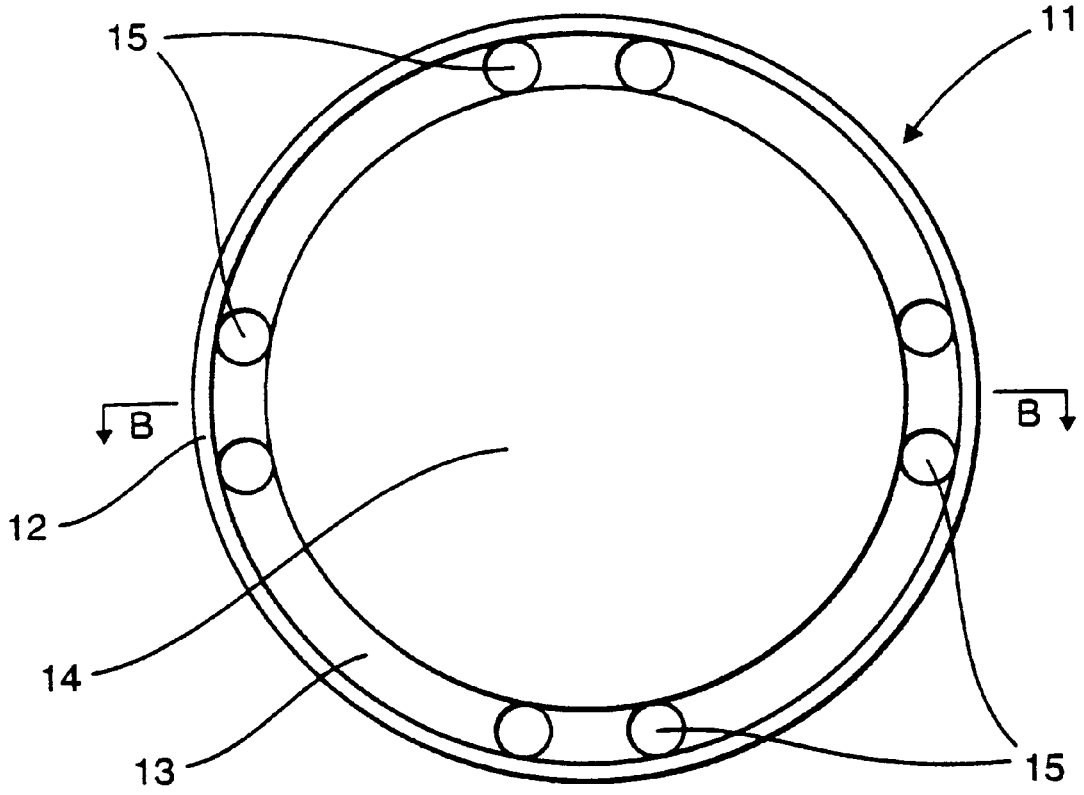
FIG. 6 is a top plan view of the button cover of the magnetic button of the present invention.
Figure 7:
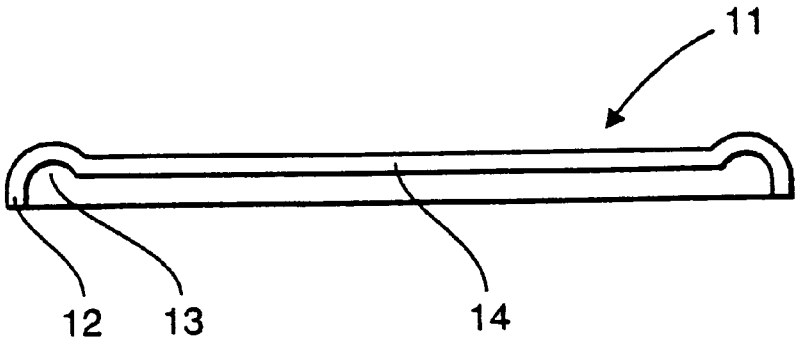
FIG. 7 is a sectional view of the button cover cut along line B—B in FIG. 6.

With reference to FIGS. 6 and 7, the button cover 11 is formed by pressing the steel sheet and undergoes anti-rust treatment, such as electroplating or baking finish. Its external shape can match with the magnetic button. It is generally round in shape, and there is no vertically extended surrounding edge 12 around it, closely nearby the surrounding edge 12 is a O-ring groove 13, a little inward is a plane 14 for attracting the magnetic button, and on the o-ring groove 13 are through holes 15 for fixing.

The above is merely an example of the present invention, and those skilled in the art can make any alteration or modification without deviating from the present design within the scope of the present invention. However, it is to be understood that these shall also fall within the scope of the present invention.

What is claimed is:

1. A magnetic button comprising:

a button body having a decorative top button face, said top button face being a swelled extending surface, and around it having an edge portions lower than the surface of the top button face, said edge portions being provided with through holes for affixing the magnetic button, and the reverse side being generally a flat back button face, a cavity being disposed inbetween said top button face and back button face;

a magnet disposed inside the cavity of said button body, one side having an N pole and the other, an S pole respectively, and being made of strong magnetic alloy a steel plate having a shape and size that match with said magnet and having an edge vertically extended so that the extended edge surrounds the magnet, such that the steel plate is placed on the magnet and the height of the extended edge is about equal to the thickness of the magnet.

2. The magnetic button according to claim 1, wherein said button body is made of non-magnetic material, preferably made of materials selected from nylon, PVC, ABS plastics, resin, etc.

3. The magnetic button according to claim 1, wherein said magnet is made of neodymium-iron-boron alloy of strong magnetism, maximum magnetic field density of 1,500 Gauss.

4. The magnetic button according to claim 1, wherein the thickness of said button body is 2.5–3.5 mm.

5. The magnetic button according to claim 1, wherein the thickness of said magnet is 1.0–1.5 mm.

6. The magnetic button according to claim 1, wherein the thickness of said steel plate is 0.5–0.6 mm.

7. The magnetic button according to claim 1 including a resinoid covering said steel plate and filling the remainder of said cavity of said button body.

8. A method of manufacturing a magnetic button comprising the steps of:

Step A: making a button body with non-magnetic materials, which button body has a decorative top button face, said top button face having a swelled extending surface, and around it having an edge portion that is lower than the surface of top button plate, said edge portion being provided with through holes for affixing the magnetic button, and on the reverse side defining a cavity;

Step B: placing the magnet being made of strong magnetic alloy into said cavity in a fixed magnetic pole direction, then setting S pole against top button face and putting it into the formed magnetic button with a sign "magnetic button A1", then set the N pole against back button face and putting it into the formed magnetic button with a sign "magnetic button B1"; then putting in a steel plate so that the plate joins with the magnetic due to magnetic force of the magnet with a vertically extending edge portion surrounding the magnet; and Step C: injecting the resinoid into the cavity of the button body which has been disposed with the magnet and steel plate, such that said magnet and steel plate are completely sealed within the button body and combined integrally after being hardened.

9. The magnetic button according to claim 8, wherein said button body is made of material preferably selected from nylon, PVC, ABS plastics, resin, etc., the thickness of said button body is 2.5–3.5 mm.

10. The magnetic button according to claim 8, wherein said magnet is made of neodymium-iron-boron alloy of strong magnetism having a maximum magnetic field density of 1,500 Gauss, the thickness of said magnet is 1.0–1.5 mm.

11. The magnetic button according to claim 8, wherein the thickness of said steel plate is 0.5–0.6 mm.

* * * * *